US005836770A

United States Patent [19]

Powers

[11] Patent Number: 5,836,770

[45] Date of Patent: Nov. 17, 1998

[54] MULTIMEDIA PRODUCT FOR USE IN PHYSICAL FITNESS TRAINING AND METHOD OF MAKING

[76] Inventor: Beth J. Powers, 139 Harbor Rd., Lake Barrington, Ill. 60010

[21] Appl. No.: 727,749

[22] Filed: Oct. 8, 1996

[51] Int. Cl.[6] ..... A63B 69/00

[52] U.S. Cl. ..... 434/247; 434/256; 434/257; 482/902

[58] Field of Search ..... 434/247, 256, 434/257, 307 R; 482/8, 902, 901; 473/131, 278

[56] References Cited

U.S. PATENT DOCUMENTS 4,015,344 4/1977 Michaels et al. ..... 434/257
5,184,295 2/1993 Mann ..... 434/249
5,249,967 10/1993 O'Leary et al. ..... 434/247
5,513,991 5/1996 Reynolds et al. ..... 434/307 R
5,603,617 2/1997 Light ..... 473/278

*Primary Examiner*—Glenn E. Richman
*Attorney, Agent, or Firm*—David H. Judson

[57] ABSTRACT

A multimedia product for use in physical fitness training comprises a player-readable storage medium having a substrate and audiovisual program data encoded in the substrate. The audiovisual program data comprises first and second routines of physical movements sequentially captured from a first perspective. The first and second routines have at least some mirror-image or "opposed" physical movements such that when the program data is read by a player and displayed, the first and second routines are juxtaposed in a predetermined "split-screen" format. A method of making the product is also described.

14 Claims, 1 Drawing Sheet

MULTIMEDIA PRODUCT FOR USE IN PHYSICAL FITNESS TRAINING AND METHOD OF MAKING

TECHNICAL FIELD

The present invention relates generally to educational instruction and, more particularly, to a physical fitness instructional product (e.g., a video) and its method of manufacture.

BACKGROUND OF THE INVENTION

Frequent exercise is critical to maintaining one's good health and well-being. Since exercise regimens are often highly specialized, a well-defined industry has been created whose goal is the providing of educational services and products to aid in fitness instruction. Thus, for example, many health clubs and facilities provide classes of personal instruction in which instructors "teach" students a series of physical movements designed to exercise various muscles and increase overall physical capability. Typically, such classes are provided in a large room having a mirror. The teacher illustrates the various steps by facing the mirror, thereby allowing the students to see the movements from both the front and back perspective.

Another approach to fitness instruction is the so-called fitness "video", which is a video recording of an exercise routine "taught" by one or more personalities. Such videos are used to supplement, or in place of, personal "classroom" instruction. While they are quite popular, prior art fitness videos are very difficult to use because the routines in these videos are "front-oriented". In other words, known instructional videos present the teacher from the front, and thus students viewing the tape at home must "reverse" the instructor's movements in order to properly follow along. As a result, fitness videos may be used once or twice before they are consigned to the shelf. The user may then become discouraged, thereby increasing the likelihood that the exercise program will be short-lived.

Therefore, there is a long-felt need in the industry to provide instructional materials for physical fitness that are easy to use, that promote good exercise habits, and that approximate the environment of exercising along with a knowledgeable personal instructor.

BRIEF SUMMARY OF THE INVENTION

It is a primary object of the invention to provide physical fitness training materials that facilitate various type of exercises.

It is another object to provide such training materials in a multimedia format and, more particularly, using a novel split screen video format in which an instructor is shown performing an exercise routine (or portion thereof) in more than perspective at the same time.

It is a more specific object to provide a fitness video in which an instructor is shown simultaneously from the front and back to allow an exerciser to follow along with an exercise regimen as if in a live teaching environment.

It is a further important object of the invention to describe a method of making an instructional video illustrating a fitness routine in a split screen format.

Yet another more general object of the invention is to enhance physical fitness training.

A multimedia product for use in physical fitness training according to the invention comprises a player-readable storage medium having a substrate, and audiovisual program data encoded in the substrate of the player-readable storage medium. The audiovisual program data comprises a first routine of physical movements captured from a first perspective by a video recorder, and a second routine of physical movements captured from the first perspective. The first and second routines have substantially mirror-image physical movements such that when the program data is read by a player and displayed on a display the first and second routines are juxtaposed in a predetermined split-screen format.

In a preferred embodiment, the player-readable storage medium is a videotape in a known VHS format and the player is a conventional video recording/player device that is connected to a conventional television. Alternatively, the player-readable storage medium is a CD-ROM and the player is a CD-ROM player of a conventional personal computer.

A method of making such a multimedia product for use in fitness training begins by video recording a first routine of physical movements from a first perspective to generate a first recording. Subsequently, a video recording of a second routine of physical movements is made from the first perspective to generate a second recording. The first and second routines of physical movements have at least some mirror-image movements. Thereafter, the first and second recordings are edited or spliced together into a master recording and stored in a player-readable storage medium (e.g., a videotape, CD-ROM, laser disk, or newly-developed media) such that when the storage medium is played on a player the first and second routines of physical movements are displayed in a split-screen format.

The foregoing has outlined some of the more pertinent objects of the present invention. These objects should be construed to be merely illustrative of some of the more prominent features and applications of the invention. Many other beneficial results can be attained by applying the disclosed invention in a different manner or modifying the invention as will be described. Accordingly, other objects and a fuller understanding of the invention may be had by referring to the following Detailed Description of the preferred embodiment.

BRIEF DESCRIPTION OF THE DRAWINGS

For a more complete understanding of the present invention and the advantages thereof, reference should be made to the following Detailed Description taken in connection with the accompanying drawings in which.

DETAILED DESCRIPTION

At the outset, it should be appreciated that the following discussion is directed to the making of a physical fitness video product for use in training individuals in an exercise regimen. The invention, however, should not be considered limited to this particular application as "split-screen" techniques described herein are quite useful for other purposes including, without limitation, dance training, sports training, machine training, and the like. Indeed, the inventive techniques and product may be practiced irrespective of the particular "content" or subject matter of the program whenever it is desired to illustrate or provide a split-screen image of a person performing a task from two different perspectives. Generally, the two different perspectives are the "front" and "back" of the person, but this is not a limitation of the invention either, as the split-screen image may illustrate the person performing a given task from any two different perspectives.

Figure 1:
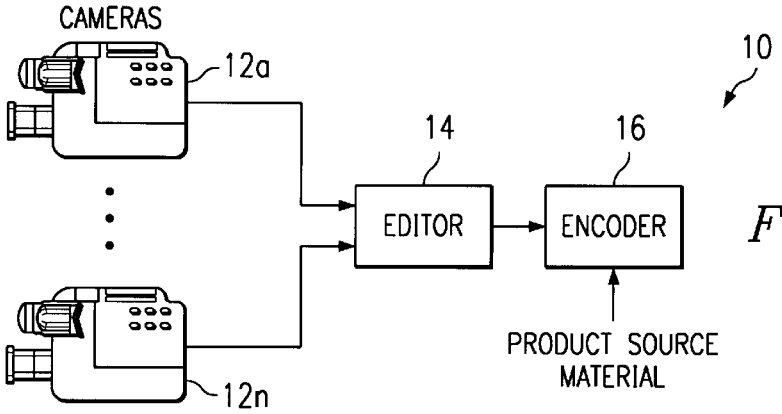
FIG. 1 illustrates a production environment for use in making the novel split screen product of the present invention.
Figure 2:
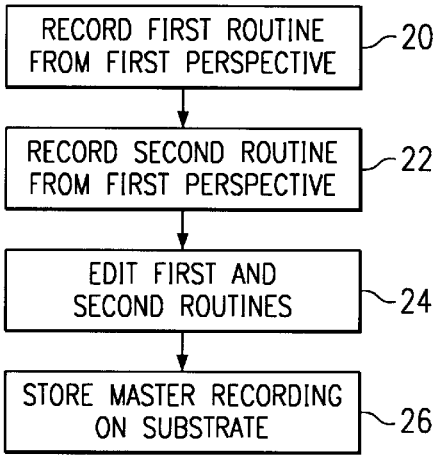
FIG. 2 is a flowchart showing a preferred method of making the product according to the invention.

Referring now to FIG. 1, a production system is shown for developing and creating multimedia materials for use in fitness training. Development system 10 as shown in FIG. 1 implements a production environment and includes one or more video cameras 12*a*–12*n*, a video editing device 14 and a video encoding device 16. A preferred process of making the multimedia product is shown in the flowchart of FIG. 2. Generally, the method involves a combination of filming the routines multiple times with multiple cameras and intricate editing. The routines are first filmed from the front perspective, with multiple cameras preferably being utilized to secure close-up shots of facial expressions, footwork, muscle groups, and angled views of the routines. Thereafter, the instructor turns around and performs the routine in substantially complete opposition, or in a so-called "mirror-image" manner, so that the two primary views will move to the right and left in synchronization when appearing together on the video. During the editing process, as provided by the video editing device 14, the multiple views are placed into juxtaposition so that a preferably "front" and "back" view of the same routine (or any portion thereof) are provided. The program data is then placed onto the master tape by the encoding device 16 to create the final product.

Thus, according to the preferred method, a first routine of physical movements is recorded by video camera 12*a* from a first perspective to generate a first recording. This is step 20 in FIG. 2. Then, at step 22, a second routine of physical movements is then recorded (preferably again by the same video camera 12*a*, although this is not required) from the first perspective (or from substantially the first perspective) to generate a second recording. The first and second routines of physical movements have at least some mirror-image movements. At step 24, the first and second recordings are edited together by the video editing device to generate a master recording having a split-screen format for at least the mirror-image movements. At step 26, the master recording is then stored in a player-readable storage medium (e.g, a blank videotape) such that when the storage medium is the played on a player, the first and second routines of physical movements are displayed in a split-screen format.

If desired, the video cameras may be used to record one or more additional routines of physical movements that are related to the first and/or second routines in some way. Such recording, for example, might illustrate close-up shots of facial expressions, footwork, muscle groups, and angled views of the routines. This third recording (or multiple other recordings) may then be edited into the master recording. Preferably, at least one of the first and second recordings includes an audio track synchronized with the video track to provide audible instructions.

Figure 3:
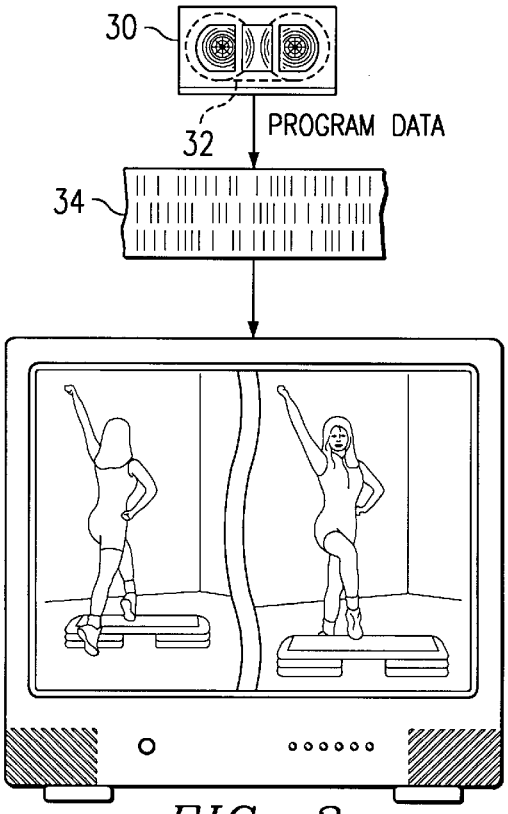
FIG. 3 is an example of a multimedia product according to the invention which includes program data that generates the split screen video format showing a front and back view of an instructor performing an exercise routine.

FIG. 3 shows the preferred multimedia product as a videotape 30 that is designed to be played in a conventional videotape recording/player device. Such devices are well-known and may be a standalone device connected to a television or a device integrated with a television receiver. As seen in FIG. 3, the product includes a substrate 32 (e.g., a video tape) having a substrate. Audiovisual program data 34 is encoded in the substrate and comprises at least the first routine (captured from the first perspective) and the second routine (captured from substantially the first perspective), with the first and second routines having some mirror-image physical movements. Of course, the program data 34 may include other video program data, synchronized audio data, and other program material. Generally, the first routine of physical movements illustrates a frontal view of an instructor performing an exercise regimen and the second routine of physical movements illustrates a back view of the instructor performing the exercise regimen.

While in the preferred embodiment the multimedia product is a videotape, the invention is not so limited. The product may be a CD-ROM, a laser disk, information broadcast over a conventional video medium (e.g., television, cable, pay-per-view or the like) or even digital program data downloaded from a computer network such as the Internet or World Wide Web.

The primary advantage is that when the product is played in a player device, the screen is split in half, which thus shows the view of the instructor from behind (preferably on the left side of the screen) and the view of the instructor from the front (preferably on the right side), as illustrated in FIG. 3. This allows the home exerciser to follow the instructor without having to reverse the movements. This means the exerciser will be using the same foot and arm as the instructor, rather than the opposite. Although not required, preferably the full back view is always shown so that the home exerciser is never without a view of the footwork. The exerciser sees the arm placements as well as the instructor's facial expressions by watching the front view on the right side. This screen set-up emulates the environment a student would experience if taking the class live in a studio where there is a mirror to display the teacher's front side, but where the teacher is facing the same direction as the students.

Figure 4:
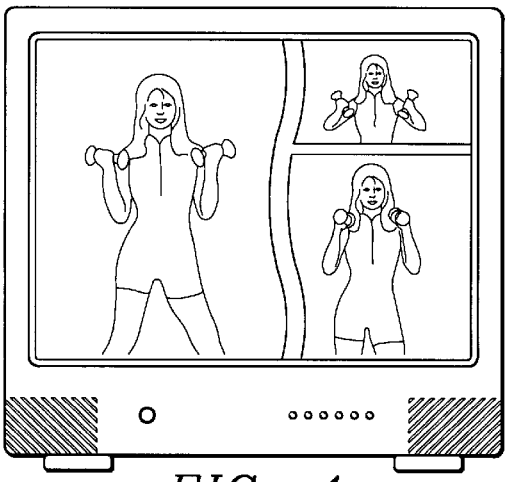
FIG. 4 is an example of an alternate screen format wherein an additional area of the display screen is dedicated to providing still other content related to the split-screen images.

The split screen may also be used to show the close-ups of the muscle groups which are being worked as well as close-ups of footwork and the instructor's face. As seen in FIG. 4, sometimes the screen will be split into three sections to show both a close-up and the full front view of the instructor with the full back view on the left. It is also used to provide the home exerciser with maximum variety during the training regimen. The basic exercise is presented on the left and a more advanced variation is presented on the right, so the home exerciser may choose from different exercises which work the same muscle group. Sometimes the screen is split horizontally to accommodate the exercises, and sometimes three different variations are presented with the screen split into three sections.

While the split-screen approach shown in FIG. 3 is preferred, it should be appreciated that the present invention contemplates display of the first and second routines in any predetermined format, such as through a pop-up or dedicated window. Thus, for example, the back view may be the primary screen image, with the front view then superimposed within a small pop-up screen.

Having described my invention, what I claim is now set forth in the following claims:

In the claims:

1. A multimedia product for use in physical fitness training, comprising:

a player-readable storage medium having a substrate;

audiovisual program data encoded in the substrate of the player-readable storage medium, wherein the audiovisual program data comprises:

a first routine of physical movements captured from a first perspective; and a second routine of physical movements captured from the first perspective;

wherein the first and second routines have mirror image physical movements such that when the program data is read by a player and displayed the first and second routines are juxtaposed in a predetermined format.

2. The multimedia product as described in claim 1 wherein the player-readable storage medium is a videotape, the player is a videotape recorder and the predetermined format is a split-screen display.

3. The multimedia product as described in claim 1 wherein the player-readable storage medium is a CD-ROM, the player is a CD-ROM and the predetermined format is a split-screen display.

4. The multimedia product as described in claim 1 wherein the first and second routines of physical movements comprise physical exercise routines.

5. The multimedia product as described in claim 1 wherein the audiovisual program data further includes audio instructions synchronized with at least one of the first and second routines of physical movements.

6. The multimedia product as described in claim 1 wherein the first routine of physical movements illustrates a frontal view of an instructor performing an exercise regimen and the second routine of physical movements illustrates a back view of the instructor performing the exercise regimen.

7. The multimedia product as described in claim 1 wherein the audiovisual program data further includes a third routine of one or more physical movements related to the first and second routines, wherein when the program data is read by a player and displayed the first and second routines are displayed in a split-screen format and the third routine is juxtaposed adjacent the split-screen format.

8. A method of making a multimedia product for use in fitness training, comprising the steps of:

recording a first routine of physical movements from a first perspective to generate a first recording;

subsequently recording a second routine of physical movements from the first perspective to generate a second recording, the first and second routines of physical movements having at least some mirror-image movements; and editing the first and second recordings together into a master recording having a split-screen format; and storing the master recording in a player-readable storage medium such that when the storage medium is played on a player the first and second routines of physical movements are displayed in the split-screen format.

9. The method of making as described in claim 8 wherein the player-readable storage medium is a videotape.

10. The method of making as described in claim 8 wherein the player-readable storage medium is a CD-ROM.

11. The method of making as described in claim 8 further including the steps of:

recording a third routine of physical movements related to the first and second routines of physical movements to generate a third recording; and editing the third recording together with the first and second recordings.

12. The method of making as described in claim 8 wherein at least one of the first and second recordings includes an audio track synchronized with a video track.

13. The method of making as described in claim 8 wherein the first routine of physical movements illustrates a frontal view of an instructor performing an exercise regimen and the second routine of physical movements illustrates a back view of the instructor performing the exercise regimen.

14. The method of making as described in claim 8 wherein the player-readable storage medium is a laser disk.

* * * * *